US011645967B2

(12) United States Patent
Xi

(10) Patent No.: US 11,645,967 B2
(45) Date of Patent: May 9, 2023

(54) GATE DRIVING CIRCUIT AND DISPLAY PANEL

(71) Applicant: Shenzhen China Star Optoelectronics Semiconductor Display Technology Co., Ltd., Guangdong (CN)

(72) Inventor: Suping Xi, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 374 days.

(21) Appl. No.: 17/055,617

(22) PCT Filed: Oct. 23, 2020

(86) PCT No.: PCT/CN2020/123294

§ 371 (c)(1),
(2) Date: Nov. 16, 2020

(87) PCT Pub. No.: WO2022/047932

PCT Pub. Date: Mar. 10, 2022

(65) Prior Publication Data

US 2022/0309988 A1 Sep. 29, 2022

(30) Foreign Application Priority Data

Sep. 4, 2020 (CN) ..... 202010920166.0

(51) Int. Cl.
*G09G 3/20* (2006.01)

(52) U.S. Cl.
CPC ... *G09G 3/2092* (2013.01); *G09G 2300/0426* (2013.01); *G09G 2300/0876* (2013.01); *G09G 2310/08* (2013.01)

(58) Field of Classification Search
CPC ..... G09G 3/3266; G09G 3/367; G09G 2310/0267; G09G 2310/0286
See application file for complete search history.

(56) References Cited

U.S. PATENT DOCUMENTS

| | | | | |
|---|---|---|---|---|
| 5,777,937 | A | 7/1998 | Shirley | |
| 2006/0145999 | A1 | 7/2006 | Cho et al. | |
| 2009/0091350 | A1 | 4/2009 | Blodgett et al. | |
| 2014/0176410 | A1 * | 6/2014 | Ma | G11C 19/28 327/109 |
| 2015/0187302 | A1 * | 7/2015 | Dai | G09G 3/006 345/92 |

(Continued)

FOREIGN PATENT DOCUMENTS

| | | |
|---|---|---|
| CN | 104537991 | 4/2015 |
| CN | 108831400 | 11/2018 |
| CN | 111312146 | 6/2020 |

*Primary Examiner* — Sepehr Azari

(57) ABSTRACT

A gate driving circuit and a display panel are provided. The gate driving circuit reduces the number of transistors through the inverter in the pull-down maintaining circuit such that the number of the signal output ends connected to the inverter is reduced. In this way, the number of the other transistors in the pull-down maintaining circuit is also reduced. Therefore, the number of the transistors and the number of the signal output ends of the pull-down maintaining circuit are both reduced. This means that the number of the transistors and the number of the signal output ends of the gate driving circuit are both reduced.

18 Claims, 4 Drawing Sheets

(56) References Cited

U.S. PATENT DOCUMENTS

| | | | | |
|---|---|---|---|---|
| 2016/0351152 | A1* | 12/2016 | Dai | H01L 29/7869 |
| 2019/0019471 | A1* | 1/2019 | Zeng | G11C 19/28 |
| 2019/0049768 | A1* | 2/2019 | Lv | G02F 1/13306 |

* cited by examiner

GATE DRIVING CIRCUIT AND DISPLAY PANEL

RELATED APPLICATIONS

This application is a National Phase of PCT Patent Application No. PCT/CN2020/123294 having International filing date of Oct. 23, 2020, which claims the benefit of priority of Chinese Patent Application No. 202010920166.0 filed on Sep. 4, 2020. The contents of the above applications are all incorporated by reference as if fully set forth herein in their entirety.

FIELD AND BACKGROUND OF THE INVENTION

The present invention relates to a display technology, and more particularly, to a gate driving circuit and a display panel.

BACKGROUND

In order to reduce the cost and the size of the side frame of the conventional display device, a gate driver on array (GOA) circuit, also known as the gate driving circuit, is implemented in the display panel. In this way, the gate driver chip is not required and the side frame could be smaller. However, in the gate driving circuit, in order to ensure the accuracy of the waveform of the gate output voltage, a pull-up control circuit, a pull up circuit, a pull down circuit, a pull-down maintaining circuit, a bootstrap capacitor, a signal transmission circuit are implemented in the GOA circuit such that the GOA circuit could normally work. But the number of the transistors in the GOA circuit is huge and thus the occupied space of the transistors is also huge. The causes the side frame to be huge and cannot meet the narrow side frame demand.

From the above, it could be understood that the conventional display panel has a huge number of transistors in the gate driving circuit and thus has the issue of larger side frame because transistors occupy a huge space.

SUMMARY OF THE INVENTION

Technical Problem

One objective of an embodiment of the present invention is to provide a gate driving circuit and a display panel to solve the above-mentioned issue of large side frame due to the occupied space of the transistors in the gate driving circuit.

According to an embodiment of the present invention, a gate driving circuit is disclosed. The gate driving circuit comprises: a pull-up control circuit, electrically connected to a first node, configured to pull up a voltage level of the first node in a display phase; a signal transmission circuit, electrically connected to the first node and the pull-up control circuit, configured to pull up a voltage level of a first stage signal output end; a pull up circuit, electrically connected to the first node and the pull-up control circuit, configured to pull up a voltage level of a first signal output end; a pull down circuit, electrically connected to the first node, configured to pull down a voltage level of the first node in the display phase; and a pull-down maintaining circuit, electrically connected to the first node, configured to maintain a low voltage level of the first node. The pull-down maintaining circuit comprises: a low voltage level input end; and an inverter. The inverter comprises: a first transistor; a second transistor; and a third transistor. A gate of the third transistor is electrically connected to the first node. A first electrode of the third transistor is electrically connected to a second electrode of the first transistor. A second electrode of the second transistor and a second signal output end. A second electrode of the third transistor is electrically connected to the low voltage level input end.

In some embodiments, the inverter further comprises a high voltage level end, a first low frequency clock signal end and a second low frequency clock signal end. A gate of the first transistor is electrically connected to the first low frequency clock signal end. A first electrode of the first transistor is electrically connected to the high voltage level end. A gate of the second transistor is electrically connected to the second low frequency clock signal end. A first electrode of the second transistor is electrically connected to the high voltage level end.

In some embodiments, the pull-down maintaining circuit further comprises a fourth transistor, a fifth transistor, the first node, and a second signal output end. A gate of the fourth transistor is electrically connected to the second signal output end. A first electrode of the fourth transistor is electrically connected to the first node, and a second electrode of the fourth transistor is electrically connected to the low voltage level input end. A gate of the fifth transistor is electrically connected to the second signal output end. A first electrode of the fifth transistor is electrically connected to the first signal output end, and a second electrode of the fifth transistor is electrically connected to the low voltage level input end.

In some embodiments, the pull-up control circuit comprises a sixth transistor, a first stage signal input end, and a first signal input end. A gate of the sixth transistor is electrically connected to the first stage signal input end, a first electrode of the sixth transistor is electrically connected to the first signal input end, and a second electrode of the sixth transistor is electrically connected to the first node.

In some embodiments, the signal transmission circuit comprises a seventh transistor and the first stage signal output end. A gate of the seventh transistor is electrically connected to the first node. A first electrode of the seventh transistor is electrically connected to a first clock signal input end, and a second electrode of the seventh transistor is electrically connected to the first stage signal output end.

In some embodiments, the pull up circuit comprises an eighth transistor, the first clock signal input end and the first signal output end. A gate of the eighth transistor is electrically connected to the first node. A first electrode of the eighth transistor is electrically connected to the first clock signal input end, and a second electrode of the eighth transistor is electrically connected to the first signal output end.

In some embodiments, the pull down circuit comprises a ninth transistor, a tenth transistor and a second signal input end. A gate of the ninth transistor is electrically connected to the second signal input end. A first electrode of the ninth transistor is electrically connected to the low voltage level end. A second electrode of the ninth transistor is electrically connected to the first signal output end. A gate of the tenth transistor is electrically connected to the second signal input end. A first electrode of the tenth transistor is electrically connected to the low voltage level end, and a second electrode of the tenth transistor is electrically connected to the first node.

In some embodiments, the gate driving circuit further comprises a bootstrap capacitor. A first plate of the bootstrap capacitor is electrically connected to the first node and a second plate of the bootstrap capacitor is electrically connected to the first signal output end.

In some embodiments, the gate driving circuit further comprises a reset circuit that includes a reset signal end and a reset transistor. A gate of the reset transistor is electrically connected to the reset signal end. A first electrode of the reset transistor is electrically connected to the first node, and a second electrode of the reset transistor is electrically connected to the low voltage level end.

In some embodiments, the third transistor is an amorphous silicon (a-Si) TFT or an Indium gallium zinc oxide (IGZO) TFT.

In some embodiments, the third transistor is an N-type transistor and a P-type transistor.

According to an embodiment of the present invention, a display panel is disclosed. The gate driving circuit comprises: a pull-up control circuit, electrically connected to a first node, configured to pull up a voltage level of the first node in a display phase; a signal transmission circuit, electrically connected to the first node and the pull-up control circuit, configured to pull up a voltage level of a first stage signal output end; a pull up circuit, electrically connected to the first node and the pull-up control circuit, configured to pull up a voltage level of a first signal output end; a pull down circuit, electrically connected to the first node, configured to pull down a voltage level of the first node in the display phase; and a pull-down maintaining circuit, electrically connected to the first node, configured to maintain a low voltage level of the first node. The pull-down maintaining circuit comprises: a low voltage level input end; and an inverter. The inverter comprises: a first transistor; a second transistor; and a third transistor. A gate of the third transistor is electrically connected to the first node. A first electrode of the third transistor is electrically connected to a second electrode of the first transistor. A second electrode of the second transistor and a second signal output end. A second electrode of the third transistor is electrically connected to the low voltage level input end.

In some embodiments, the inverter further comprises a high voltage level end, a first low frequency clock signal end and a second low frequency clock signal end. A gate of the first transistor is electrically connected to the first low frequency clock signal end. A first electrode of the first transistor is electrically connected to the high voltage level end. A gate of the second transistor is electrically connected to the second low frequency clock signal end. A first electrode of the second transistor is electrically connected to the high voltage level end.

In some embodiments, the pull-down maintaining circuit further comprises a fourth transistor, a fifth transistor, the first node, and a second signal output end. A gate of the fourth transistor is electrically connected to the second signal output end. A first electrode of the fourth transistor is electrically connected to the first node, and a second electrode of the fourth transistor is electrically connected to the low voltage level input end. A gate of the fifth transistor is electrically connected to the second signal output end. A first electrode of the fifth transistor is electrically connected to the first signal output end, and a second electrode of the fifth transistor is electrically connected to the low voltage level input end.

In some embodiments, the pull-up control circuit comprises a sixth transistor, a first stage signal input end, and a first signal input end. A gate of the sixth transistor is electrically connected to the first stage signal input end, a first electrode of the sixth transistor is electrically connected to the first signal input end, and a second electrode of the sixth transistor is electrically connected to the first node.

In some embodiments, the signal transmission circuit comprises a seventh transistor and the first stage signal output end. A gate of the seventh transistor is electrically connected to the first node. A first electrode of the seventh transistor is electrically connected to a first clock signal input end, and a second electrode of the seventh transistor is electrically connected to the first stage signal output end.

In some embodiments, the pull up circuit comprises an eighth transistor, the first clock signal input end and the first signal output end. A gate of the eighth transistor is electrically connected to the first node. A first electrode of the eighth transistor is electrically connected to the first clock signal input end, and a second electrode of the eighth transistor is electrically connected to the first signal output end.

In some embodiments, the pull down circuit comprises a ninth transistor, a tenth transistor and a second signal input end. A gate of the ninth transistor is electrically connected to the second signal input end. A first electrode of the ninth transistor is electrically connected to the low voltage level end. A second electrode of the ninth transistor is electrically connected to the first signal output end. A gate of the tenth transistor is electrically connected to the second signal input end. A first electrode of the tenth transistor is electrically connected to the low voltage level end, and a second electrode of the tenth transistor is electrically connected to the first node.

In some embodiments, the gate driving circuit further comprises a bootstrap capacitor. A first plate of the bootstrap capacitor is electrically connected to the first node and a second plate of the bootstrap capacitor is electrically connected to the first signal output end.

In some embodiments, the gate driving circuit further comprises a reset circuit that includes a reset signal end and a reset transistor. A gate of the reset transistor is electrically connected to the reset signal end. A first electrode of the reset transistor is electrically connected to the first node, and a second electrode of the reset transistor is electrically connected to the low voltage level end.

Advantageous Effects

According to an embodiment of the present invention, a gate driving circuit and a display panel are provided. The gate driving circuit comprises: a pull-up control circuit, electrically connected to a first node, configured to pull up a voltage level of the first node in a display phase; a signal transmission circuit, electrically connected to the first node and the pull-up control circuit, configured to pull up a voltage level of a first stage signal output end; a pull up circuit, electrically connected to the first node and the pull-up control circuit, configured to pull up a voltage level of a first signal output end; a pull down circuit, electrically connected to the first node, configured to pull down a voltage level of the first node in the display phase; and a pull-down maintaining circuit, electrically connected to the first node, configured to maintain a low voltage level of the first node. The pull-down maintaining circuit comprises: a low voltage level input end; and an inverter. The inverter comprises: a first transistor; a second transistor; and a third transistor. A gate of the third transistor is electrically connected to the first node. A first electrode of the third transistor is electrically connected to a second electrode of the first transistor. A second electrode of the second transistor and a second signal output end. A second electrode of the third transistor is electrically connected to the low voltage level input end. The gate driving circuit reduces the number of transistors through the inverter in the pull-down maintaining circuit such that the number of the signal output ends connected to the inverter is reduced. In this way, the number of the other transistors in the pull-down maintaining circuit is also reduced. Therefore, the number of the transistors and the number of the signal output ends of the pull-down maintaining circuit are both reduced. This means that the number of the transistors and the number of the signal output ends of the gate driving circuit are both reduced. This alleviates the issue of large side frame caused by the occupied space of the transistors in the gate driving circuit.

DESCRIPTION OF SPECIFIC EMBODIMENTS OF THE INVENTION

Figure 1:
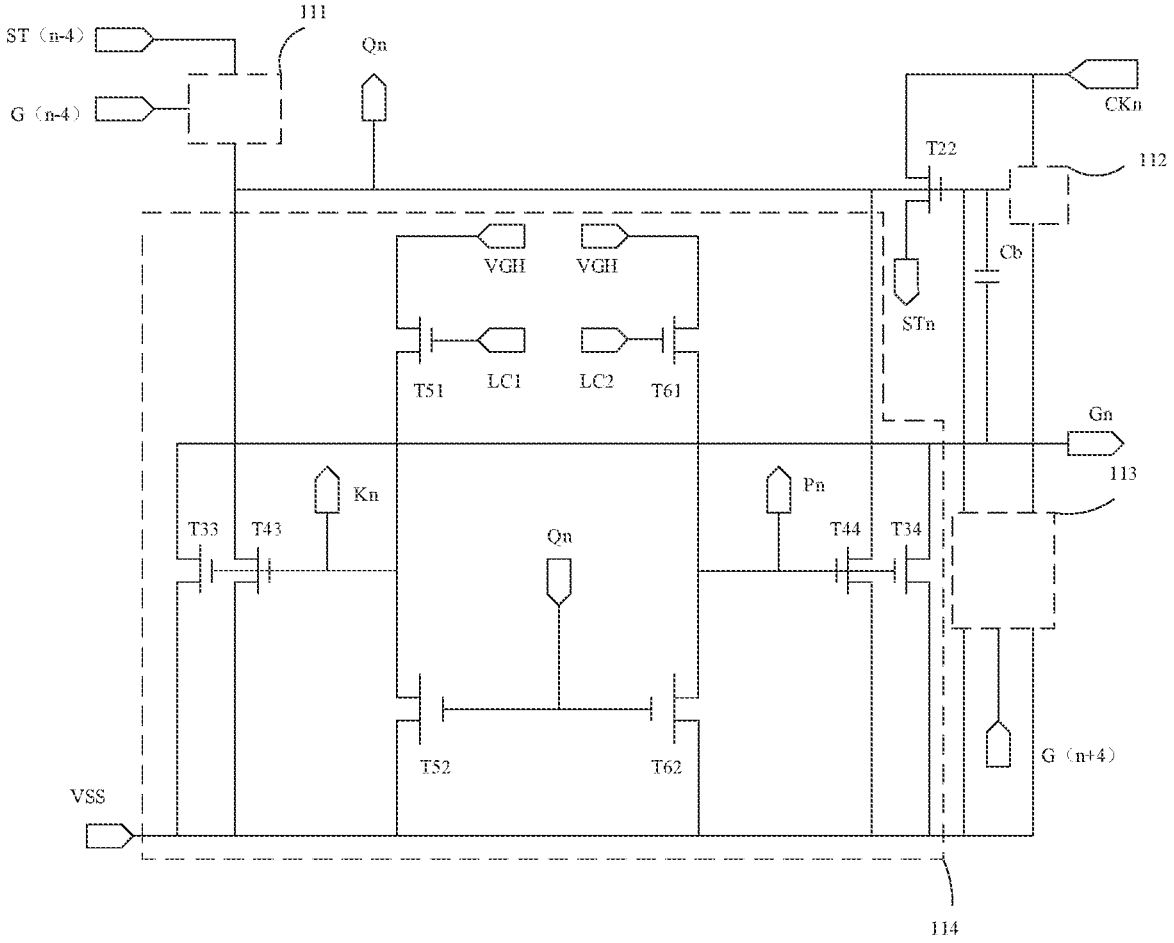
FIG. 1 is a diagram of a conventional gate driving circuit.

Embodiments of the present application are illustrated in detail in the accompanying drawings, in which like or similar reference numerals refer to like or similar elements or elements having the same or similar functions throughout the specification. The embodiments described below with reference to the accompanying drawings are exemplary and are intended to be illustrative of the present application, and are not to be construed as limiting the scope of the present application.

As previously mentioned, the conventional display panel has a larger side frame because of a huge occupied space of the transistors in the gate driving circuit. An embodiment of the present invention could alleviate the above issue.

Please refer to FIG. 1. FIG. 1 is a diagram of a conventional gate driving circuit. The conventional gate driving circuit comprises a pull-up control circuit 111, a pull up circuit 112, a pull down circuit 113, a pull-down maintaining circuit 114, a bootstrap capacitor 115. The pull-up control circuit 111 is connected to the stage signal input end ST(n−4) and a signal input end G(n−4). The pull-up control circuit is connected to the node Qn. The pull up circuit 112 is connected to the clock signal CKn. The pull up circuit 112 is connected to the transistor T22 and the bootstrap capacitor Cb. The transistor T22 is connected to the stage signal output end STn. The pull down circuit 113 is connected to the signal output end Gn. The pull down circuit 113 is connected to the signal input end G(n+4). The pull-down maintaining circuit 114 comprises an inverter, a transistor T33, a transistor T43, a transistor T44, a transistor T34, a signal output end Kn and a signal output end Pn. The inverter comprises a high voltage level end VGH, a low frequency clock signal end LC1, a low frequency clock signal end LC2, a transistor T51, a transistor T61, a transistor T52, and a transistor T62. The transistor T51 is connected to the high voltage level end VGH, the transistor T52, and the low frequency clock signal end LC1. The transistor 61 is connected to the high voltage level end VGH, the transistor T62, and the low frequency clock signal LC2. The transistor T52 is connected to the node Qn and the low voltage level end VSS. The transistor T62 is connected to the node Qn and the low voltage level end VSS. It could be seen that the number of the transistors in the gate driving circuit is comparatively huge and thus the transistors occupy more space. This makes the side frame of the display panel larger and cannot meet the demand of narrow side frame. In other words, the conventional display panel has an issue of a larger side frame because of the huge occupied space of the transistors in the gate driving circuit.

Figure 2:
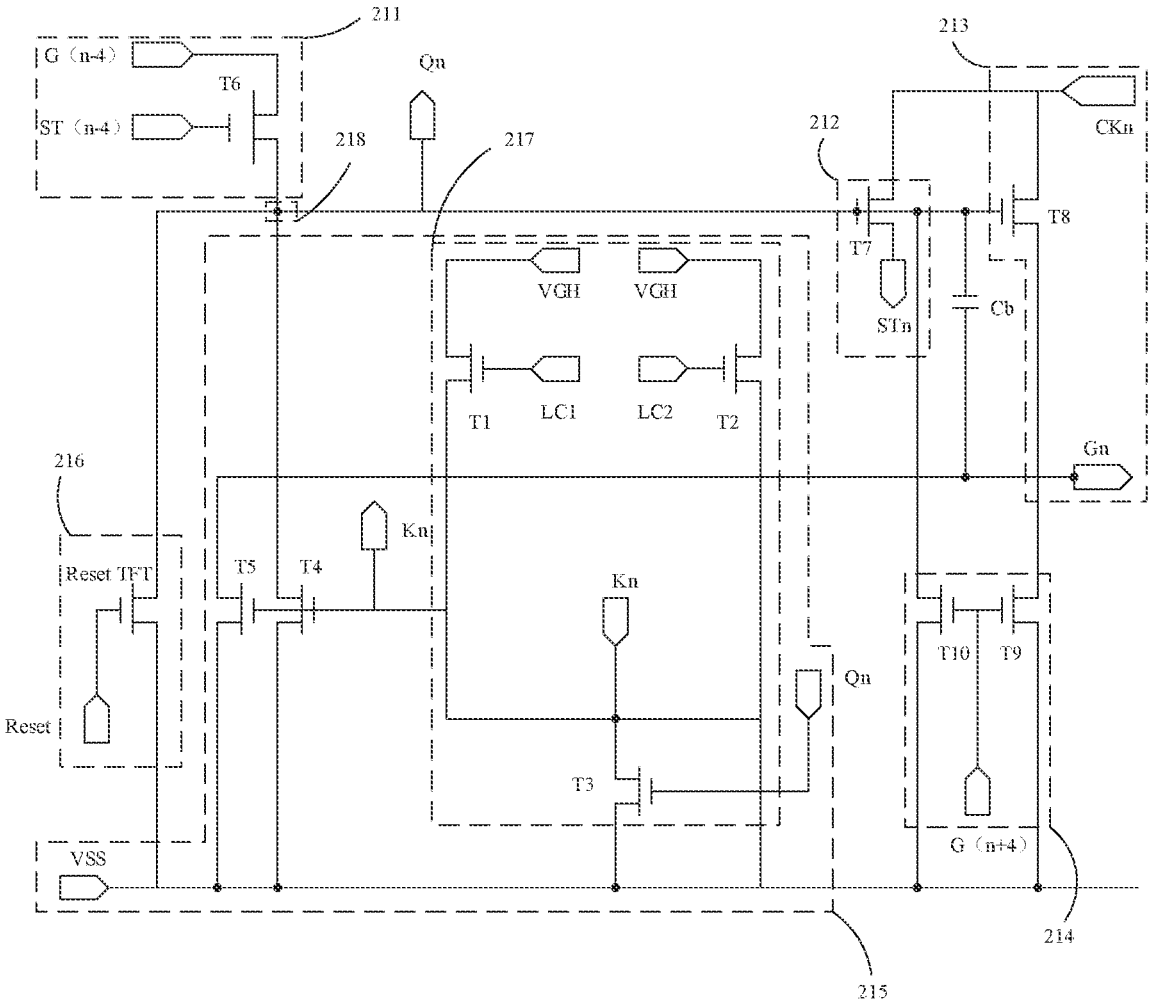
FIG. 2 is a diagram of a gate driving circuit according to an embodiment of the present invention.

Please refer to FIG. 2. FIG. 2 is a diagram of a gate driving circuit according to an embodiment of the present invention. The gate driving circuit comprises a pull-up control circuit 211, a signal transmission circuit 212, a pull up circuit 213, a pull down circuit 214 and a pull-down maintaining circuit 215.

The pull-up control circuit 211 is electrically connected to the first node Qn and is configured to pull up the voltage level of the first node in a display phase.

The signal transmission circuit 212 is electrically connected to the first node Qn and the pull-up control circuit 211 and is configured to pull up the voltage level of a first stage signal output end STn.

The pull up circuit 213 is electrically connected to the first node Qn and the pull-up control circuit 211 and is configured to pull up the voltage level of a first signal output end Gn.

The pull down circuit 214 is electrically connected to the first node Qn and is configured to pull down the voltage level of the first node Qn in the display phase.

The pull-down maintaining circuit 215 is electrically connected to the first node Qn and is configured to maintain the low voltage level of the first node Qn.

The pull-down maintaining circuit 215 comprises: a low voltage level input end VSS and an inverter 217. The converter 217 comprises a first transistor T1, a second transistor T2, and a third transistor T3. The gate of the third transistor T3 is electrically connected to the first node Qn. The first electrode of the third transistor T3 is electrically connected to the second electrode of the first transistor T1, the second electrode of the second transistor T2 and the second signal output end Kn. The second electrode of the third transistor T3 is electrically connected to the low voltage level input end VSS.

The gate driving circuit comprises: a pull-up control circuit, electrically connected to a first node, configured to pull up a voltage level of the first node in a display phase; a signal transmission circuit, electrically connected to the first node and the pull-up control circuit, configured to pull up a voltage level of a first stage signal output end; a pull up circuit, electrically connected to the first node and the pull-up control circuit, configured to pull up a voltage level of a first signal output end; a pull down circuit, electrically connected to the first node, configured to pull down a voltage level of the first node in the display phase; and a pull-down maintaining circuit, electrically connected to the first node, configured to maintain a low voltage level of the first node. The pull-down maintaining circuit comprises: a low voltage level input end; and an inverter. The inverter comprises: a first transistor; a second transistor; and a third transistor. A gate of the third transistor is electrically connected to the first node. A first electrode of the third transistor is electrically connected to a second electrode of the first transistor. A second electrode of the second transistor and a second signal output end. A second electrode of the third transistor is electrically connected to the low voltage level input end. The gate driving circuit reduces the number of transistors through the inverter in the pull-down maintaining circuit such that the number of the signal output ends connected to the inverter is reduced. In this way, the number of the other transistors in the pull-down maintaining circuit is also reduced. Therefore, the number of the transistors and the number of the signal output ends of the pull-down maintaining circuit are both reduced. This means that the number of the transistors and the number of the signal output ends of the gate driving circuit are both reduced. This alleviates the issue of large side frame caused by the occupied space of the transistors in the gate driving circuit.

In FIG. 2, the node labeled by the black circle 218 means that the two corresponding lines crossing each other at the node are conductive to each other at the node. However, FIG. 2 does not include all conductive nodes and the actual connections will be illustrated in the following embodiments.

The node Qn shown in FIG. 2 comprises a plurality of connecting ends. But the connecting ends are actually one node. In order to easily illustrate and depict, the node Qn is depicted as multiple connecting ends. However, the multiple connecting ends are actually the same node. Similarly, the node Kn is depicted as multiple connecting ends but they are actually the same node.

The inverter 217 further comprises a high voltage level end VGH, a first low frequency clock signal end LC1 and a second low frequency clock signal end LC2. The gate of the first transistor T1 is electrically connected to the first low frequency clock signal end LC1. The first electrode of the first transistor T1 is electrically connected to the high voltage level end VGH. The gate of the second transistor T2 is electrically connected to the second low frequency clock signal end LC2. The first electrode of the second transistor T2 is electrically connected to the high voltage level end VGH. In the gate driving circuit, the size of the side frame is reduced by reducing the number of the transistors in the inverter. However, in order to ensure the inverter to normally work, the inverter includes the high voltage level end, the first low frequency clock signal end, the second low frequency clock signal end, the first transistor, the second transistor, and the third transistor.

The pull-down maintaining circuit 215 further comprises a fourth transistor T4, a fifth transistor T5, the first node Qn, and a second signal output end Kn. The gate of the fourth transistor T4 is electrically connected to the second signal output end Kn. The first electrode of the fourth transistor T4 is electrically connected to the first node Qn. The second electrode of the fourth transistor T4 is electrically connected to the low voltage level input end VSS. The gate of the fifth transistor T5 is electrically connected to the second signal output end Kn. The first electrode of the fifth transistor T5 is electrically connected to the first signal output end GN. The second electrode of the fifth transistor T5 is electrically connected to the low voltage level input end VSS. In the pull-down maintaining circuit, because the number of the transistors in the inverter is reduced, the number of the signal output ends of the inverter is reduced as well. In other words, the number of transistors and the number of the signal output ends in the pull-down maintaining circuit are both reduced and thus the size of the side frame of the display panel could be reduced.

The pull-up control circuit 211 comprises a sixth transistor T6, a first stage signal input end ST(n−4), and a first signal input end G(n−4). The gate of the sixth transistor T6 is electrically connected to the first stage signal input end ST(n−4). The first electrode of the sixth transistor T6 is electrically connected to the first signal input end G(n−4). The second electrode of the sixth transistor T6 is electrically connected to the first node Qn. In the actual implementation, the pull-up control circuit could comprise only one transistor such that the number of transistors could be further reduced. In this way, the size of the side frame of the display panel could be further reduced.

The signal transmission circuit 212 comprises a seventh transistor T7 and the first stage signal output end STn. The gate of the seventh transistor T7 is electrically connected to the first node Qn. The first electrode of the seventh transistor T7 is electrically connected to a first clock signal input end CKn. The second electrode of the seventh transistor is electrically connected to the first stage signal output end STn. In the signal transmission circuit 212, the signal of the first stage signal output end STn is controlled through controlling the voltage level of the first node and the signal transmission of the clock signal.

The pull up circuit 213 comprises an eighth transistor T8, the first clock signal input end CKn and the first signal output end Gn. The gate of the eighth transistor T8 is electrically connected to the first node Qn. The first electrode of the eighth transistor T8 is electrically connected to the first clock signal input end CKn. The second electrode of the eighth transistor T8 is electrically connected to the first signal output end Gn. In the pull up circuit, only one transistor, the eighth transistor, is adopted to perform the control function such that the number of transistors could be further reduced. In this way, the size of the side frame of the display panel could be further reduced.

The pull down circuit 214 comprises a ninth transistor T9, a tenth transistor T10 and a second signal input end G(n+4). The gate of the ninth transistor T9 is electrically connected to the second signal input end G(n+4). The first electrode of the ninth transistor T9 is electrically connected to the low voltage level end VSS. The second electrode of the ninth transistor T9 is electrically connected to the first signal output end Gn. The gate of the tenth transistor T10 is electrically connected to the second signal input end G(n+4). The first electrode of the tenth transistor T10 is electrically connected to the low voltage level end VSS. The second electrode of the tenth transistor T10 is electrically connected to the first node Qn. The number of the transistors in the pull down circuit could be reduced by utilizing the ninth transistor and the tenth transistor to respectively control the voltage levels of the first node and the first signal output end. In this way, the size of the side frame of the display panel could be further reduced.

The gate driving circuit further comprises a bootstrap capacitor Cb. The first plate of the bootstrap capacitor Cb is electrically connected to the first node Qb and the second plate of the bootstrap capacitor Cb is electrically connected to the first signal output end Gn.

The gate driving circuit further comprises a reset circuit 216. The reset circuit 216 comprises a reset signal end Reset, and a reset transistor Reset TFT. The gate of the reset transistor Reset TFT is electrically connected to the reset signal end Reset. The first electrode of the reset transistor Reset TFT is electrically connected to the first node Qn. The second electrode of the reset transistor Reset TFT is electrically connected to the low voltage level end VSS. Through adopting the reset circuit in the gate driving circuit, the voltage level of the first node could be reset to prevent the voltage level of the first node from being at a high voltage level for a long time. This could prevent the gate of the transistor from being biased for a long time. In this way, the threshold voltage shift issue could be alleviated.

The third transistor is one of an amorphous silicon (a-Si) TFT and an Indium gallium zinc oxide (IGZO) TFT. That is, the third transistor could be an a-Si TFT or an IGZO TFT.

Furthermore, the first transistor and the second transistor could also be one of an a-Si TFT and an IGZO TFT.

The third transistor could be one of an N-type transistor and a P-type transistor. That is, the third transistor could be an N-type transistor or a P-type transistor.

Figure 3:
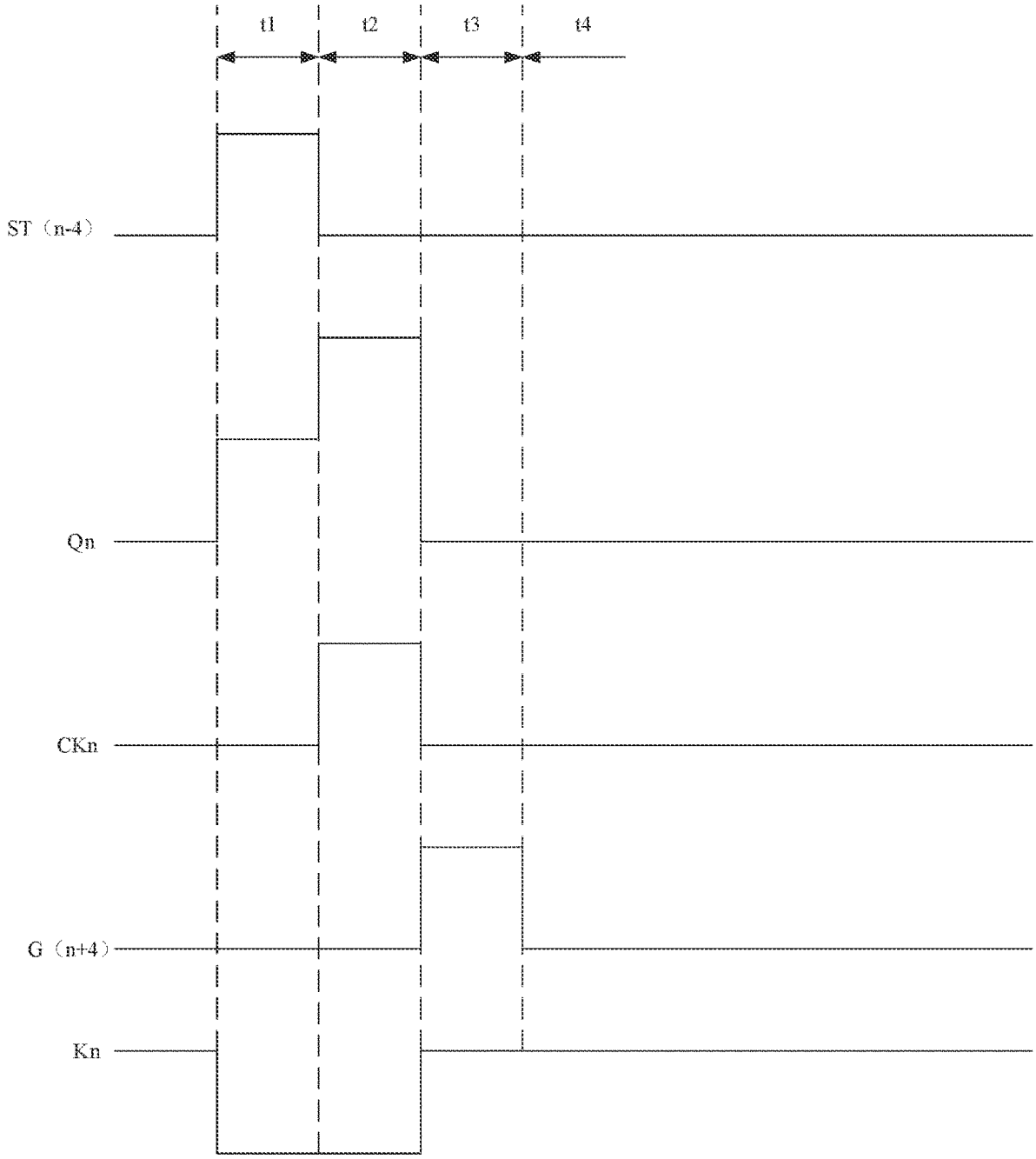
FIG. 3 is a timing diagram of a display phase of a gate driving circuit according to an embodiment of the present invention.

Please refer to FIG. 3. FIG. 3 is a timing diagram of a display phase of a gate driving circuit according to an embodiment of the present invention. The operation of the gate driving circuit will be illustrated with FIG. 2 and FIG. 3. In the first time period t1, the first stage signal input end ST(n−4) corresponds to a high voltage level. The sixth transistor T6 is turned on. The first signal input end G(n−4) corresponds to a high voltage level. The pull-up control circuit outputs a first voltage level such that the voltage level of the node Qn is pulled up to the first voltage level. Then, in the second time period t2, the first stage signal input end ST(n−4) is pulled to a low voltage level. The sixth transistor T6 is turned off. The first clock signal input end CKn receives a high voltage level. Because the first node Qn corresponds to a high voltage level, the eighth transistor T8 is turned on such that the voltage level of the first node Qn is pulled up to a second voltage level. Then, in the third time period t3, the second signal input end G(n+4) receives a high voltage level such that the ninth transistor T9 and the tenth transistor T10 are turn on. The voltage level of the first node Qn is pulled down to a low voltage level. At the same time, the signal of the second signal output end Kn of the inverter 217 corresponds to a high voltage level such that the fourth transistor and the fifth transistor are turned on. The first node Qn maintains its low voltage level. Then, in the fourth time period t4, the second signal input end G(n+4) receives a low voltage level, the signal outputted from the second signal output end Kn in the inverter 217 maintains its high voltage level such that the first node Qn maintains its low voltage level.

In this embodiment, the time periods t1-t4 are all in the display time period. In FIG. 3, the blank time period is not shown.

The operation condition of the inverter is illustrated below. As shown in FIG. 2, take the operation condition of the first low frequency clock signal end LC1 as example. Because the high voltage level end VGH keeps corresponding to a high voltage level, when the first low frequency clock signal end LC1 corresponds to a high voltage level and the second low frequency clock signal end LC2 corresponds to low voltage level, the first transistor T1 is turned and the second transistor T2 and the second transistor T3 are turned off if the first node Qn corresponds to a low voltage level. At this time, the second signal output end Kn outputs a high voltage level such that the fourth transistor T4 is turned on and the first node Qn is pulled down to a low voltage level. That is, the first node Qn maintains its low voltage level. If the first node Qn corresponds to a high voltage level, then the first transistor T1 and the third transistor T3 are turned on and the second transistor T2 is turned off. Because the first transistor T1 and the third transistor T3 are turned on, the second signal output end kn outputs a high voltage level and the fourth transistor T4 is turned off. At this time, the first node Qn maintains its high voltage level. In this way, the inverter of this embodiment could have its designed function and the number of the transistors in the inverter is reduced. Thus, the size of the side frame could be reduced.

Figure 4:
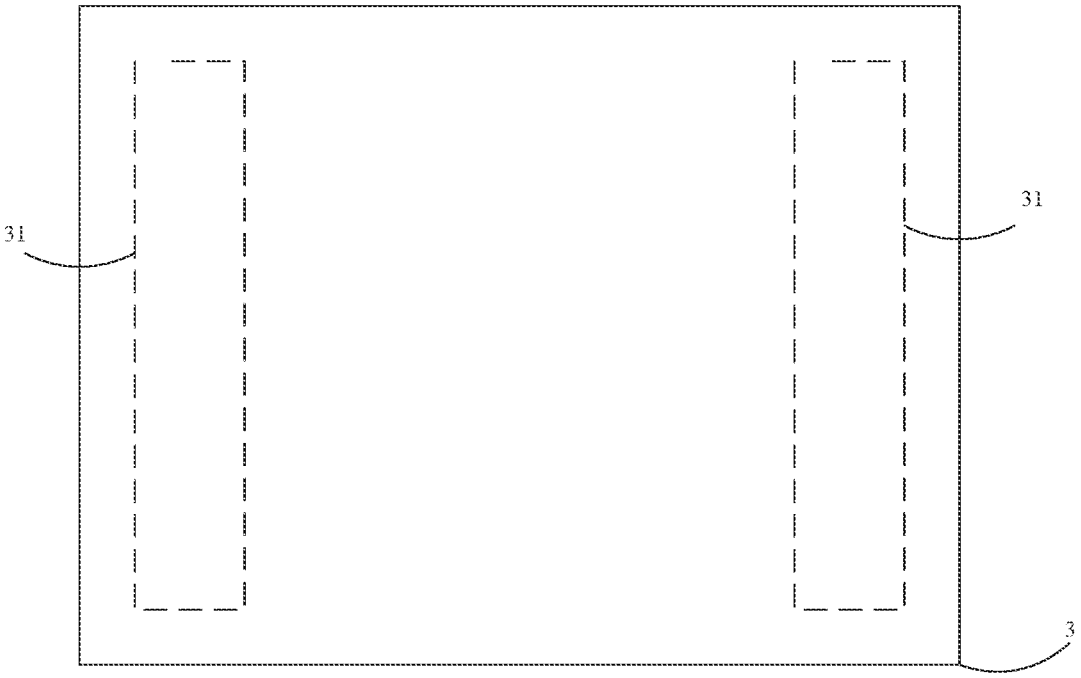
FIG. 4 is a diagram of a display panel according to an embodiment of the present invention.

Please refer to FIG. 2 and FIG. 4. FIG. 4 is a diagram of a display panel according to an embodiment of the present invention. In this embodiment, a display panel 3 is disclosed. The display panel 3 comprises a gate driving circuit 31. The gate driving circuit 31 comprises a pull-up control circuit 211, a signal transmission circuit 212, a pull up circuit 213, a pull down circuit 214 and a pull-down maintaining circuit 215.

The pull-up control circuit 211 is electrically connected to the first node Qn and is configured to pull up the voltage level of the first node in a display phase.

The signal transmission circuit 212 is electrically connected to the first node Qn and the pull-up control circuit 211 and is configured to pull up the voltage level of a first stage signal output end STn.

The pull up circuit 213 is electrically connected to the first node Qn and the pull-up control circuit 211 and is configured to pull up the voltage level of a first signal output end Gn.

The pull down circuit 214 is electrically connected to the first node Qn and is configured to pull down the voltage level of the first node Qn in the display phase.

The pull-down maintaining circuit 215 is electrically connected to the first node Qn and is configured to maintain the low voltage level of the first node Qn.

The pull-down maintaining circuit 215 comprises: a low voltage level input end VSS and an inverter 217. The converter 217 comprises a first transistor T1, a second transistor T2, and a third transistor T3. The gate of the third transistor T3 is electrically connected to the first node Qn. The first electrode of the third transistor T3 is electrically connected to the second electrode of the first transistor T1, the second electrode of the second transistor T2 and the second signal output end Kn. The second electrode of the third transistor T3 is electrically connected to the low voltage level input end VSS.

According to an embodiment of the present invention, a display panel is disclosed. The gate driving circuit comprises: a pull-up control circuit, electrically connected to a first node, configured to pull up a voltage level of the first node in a display phase; a signal transmission circuit, electrically connected to the first node and the pull-up control circuit, configured to pull up a voltage level of a first stage signal output end; a pull up circuit, electrically connected to the first node and the pull-up control circuit, configured to pull up a voltage level of a first signal output end; a pull down circuit, electrically connected to the first node, configured to pull down a voltage level of the first node in the display phase; and a pull-down maintaining circuit, electrically connected to the first node, configured to maintain a low voltage level of the first node. The pull-down maintaining circuit comprises: a low voltage level input end; and an inverter. The inverter comprises: a first transistor; a second transistor; and a third transistor. A gate of the third transistor is electrically connected to the first node. A first electrode of the third transistor is electrically connected to a second electrode of the first transistor. A second electrode of the second transistor and a second signal output end. A second electrode of the third transistor is electrically connected to the low voltage level input end.

In some embodiments, the inverter further comprises a high voltage level end, a first low frequency clock signal end and a second low frequency clock signal end. A gate of the first transistor is electrically connected to the first low frequency clock signal end. A first electrode of the first transistor is electrically connected to the high voltage level end. A gate of the second transistor is electrically connected to the second low frequency clock signal end. A first electrode of the second transistor is electrically connected to the high voltage level end.

In some embodiments, the pull-down maintaining circuit further comprises a fourth transistor, a fifth transistor, the first node, and a second signal output end. A gate of the fourth transistor is electrically connected to the second signal output end. A first electrode of the fourth transistor is electrically connected to the first node, and a second electrode of the fourth transistor is electrically connected to the low voltage level input end. A gate of the fifth transistor is electrically connected to the second signal output end. A first electrode of the fifth transistor is electrically connected to the first signal output end, and a second electrode of the fifth transistor is electrically connected to the low voltage level input end.

In some embodiments, the pull-up control circuit comprises a sixth transistor, a first stage signal input end, and a first signal input end. A gate of the sixth transistor is electrically connected to the first stage signal input end, a first electrode of the sixth transistor is electrically connected to the first signal input end, and a second electrode of the sixth transistor is electrically connected to the first node.

In some embodiments, the signal transmission circuit comprises a seventh transistor and the first stage signal output end. A gate of the seventh transistor is electrically connected to the first node. A first electrode of the seventh transistor is electrically connected to a first clock signal input end, and a second electrode of the seventh transistor is electrically connected to the first stage signal output end.

In some embodiments, the pull up circuit comprises an eighth transistor, the first clock signal input end and the first signal output end. A gate of the eighth transistor is electrically connected to the first node. A first electrode of the eighth transistor is electrically connected to the first clock signal input end, and a second electrode of the eighth transistor is electrically connected to the first signal output end.

In some embodiments, the pull down circuit comprises a ninth transistor, a tenth transistor and a second signal input end. A gate of the ninth transistor is electrically connected to the second signal input end. A first electrode of the ninth transistor is electrically connected to the low voltage level end. A second electrode of the ninth transistor is electrically connected to the first signal output end. A gate of the tenth transistor is electrically connected to the second signal input end. A first electrode of the tenth transistor is electrically connected to the low voltage level end, and a second electrode of the tenth transistor is electrically connected to the first node.

In some embodiments, the gate driving circuit further comprises a bootstrap capacitor. A first plate of the bootstrap capacitor is electrically connected to the first node and a second plate of the bootstrap capacitor is electrically connected to the first signal output end.

In some embodiments, the gate driving circuit further comprises a reset circuit that includes a reset signal end and a reset transistor. A gate of the reset transistor is electrically connected to the reset signal end. A first electrode of the reset transistor is electrically connected to the first node, and a second electrode of the reset transistor is electrically connected to the low voltage level end.

According to an embodiment of the present invention, a gate driving circuit and a display panel are provided. The gate driving circuit comprises: a pull-up control circuit, electrically connected to a first node, configured to pull up a voltage level of the first node in a display phase; a signal transmission circuit, electrically connected to the first node and the pull-up control circuit, configured to pull up a voltage level of a first stage signal output end; a pull up circuit, electrically connected to the first node and the pull-up control circuit, configured to pull up a voltage level of a first signal output end; a pull down circuit, electrically connected to the first node, configured to pull down a voltage level of the first node in the display phase; and a pull-down maintaining circuit, electrically connected to the first node, configured to maintain a low voltage level of the first node. The pull-down maintaining circuit comprises: a low voltage level input end; and an inverter. The inverter comprises: a first transistor; a second transistor; and a third transistor. A gate of the third transistor is electrically connected to the first node. A first electrode of the third transistor is electrically connected to a second electrode of the first transistor. A second electrode of the second transistor and a second signal output end. A second electrode of the third transistor is electrically connected to the low voltage level input end. The gate driving circuit reduces the number of transistors through the inverter in the pull-down maintaining circuit such that the number of the signal output ends connected to the inverter is reduced. In this way, the number of the other transistors in the pull-down maintaining circuit is also reduced. Therefore, the number of the transistors and the number of the signal output ends of the pull-down maintaining circuit are both reduced. This means that the number of the transistors and the number of the signal output ends of the gate driving circuit are both reduced. This alleviates the issue of large side frame caused by the occupied space of the transistors in the gate driving circuit.

Above are embodiments of the present invention, which does not limit the scope of the present invention. Any modifications, equivalent replacements or improvements within the spirit and principles of the embodiment described above should be covered by the protected scope of the invention.

What is claimed is:

1. A gate driving circuit, comprising:

a pull-up control circuit, electrically connected to a first node, configured to pull up a voltage level of the first node in a display phase;

a signal transmission circuit, electrically connected to the first node and the pull-up control circuit, configured to pull up a voltage level of a first stage signal output end;

a pull up circuit, electrically connected to the first node and the pull-up control circuit, configured to pull up a voltage level of a first signal output end;

a pull down circuit, electrically connected to the first node, configured to pull down the voltage level of the first node in the display phase; and a pull-down maintaining circuit, electrically connected to the first node, configured to maintain a low voltage level of the first node, wherein the pull-down maintaining circuit comprises:

a low voltage level input end; and an inverter, comprising:

a high voltage level end;

a first low frequency clock signal end;

a second low frequency clock signal end;

a first transistor, wherein a gate of the first transistor is electrically connected to the first low frequency clock signal end, a first electrode of the first transistor is electrically connected to the high voltage level end;

a second transistor, wherein a gate of the second transistor is electrically connected to the second low frequency clock signal end, and a first electrode of the second transistor is electrically connected to the high voltage level end; and a third transistor, wherein a gate of the third transistor is electrically connected to the first node, a first electrode of the third transistor is electrically connected to a second electrode of the first transistor, a second electrode of the second transistor and a second signal output end, and a second electrode of the third transistor is electrically connected to the low voltage level input end.

2. The gate driving circuit of claim 1, wherein the pull-down maintaining circuit further comprises a fourth transistor, a fifth transistor, and the first node; a gate of the fourth transistor is electrically connected to the second signal output end, a first electrode of the fourth transistor is electrically connected to the first node, and a second electrode of the fourth transistor is electrically connected to the low voltage level input end; a gate of the fifth transistor is electrically connected to the second signal output end, a first electrode of the fifth transistor is electrically connected to the first signal output end, and a second electrode of the fifth transistor is electrically connected to the low voltage level input end.

3. The gate driving circuit of claim 2, wherein the pull-up control circuit comprises a sixth transistor, a first stage signal input end, and a first signal input end; a gate of the sixth transistor is electrically connected to the first stage signal input end, a first electrode of the sixth transistor is electrically connected to the first signal input end, and a second electrode of the sixth transistor is electrically connected to the first node.

4. The gate driving circuit of claim 3, wherein the signal transmission circuit comprises a seventh transistor and the first stage signal output end; a gate of the seventh transistor is electrically connected to the first node, a first electrode of the seventh transistor is electrically connected to a first clock signal input end, and a second electrode of the seventh transistor is electrically connected to the first stage signal output end.

5. The gate driving circuit of claim 4, wherein the pull up circuit comprises an eighth transistor, the first clock signal input end and the first signal output end; a gate of the eighth transistor is electrically connected to the first node, a first electrode of the eighth transistor is electrically connected to the first clock signal input end, and a second electrode of the eighth transistor is electrically connected to the first signal output end.

6. The gate driving circuit of claim 5, wherein the pull down circuit comprises a ninth transistor, a tenth transistor and a second signal input end, a gate of the ninth transistor is electrically connected to the second signal input end, a first electrode of the ninth transistor is electrically connected to the low voltage level end, and a second electrode of the ninth transistor is electrically connected to the first signal output end; a gate of the tenth transistor is electrically connected to the second signal input end, a first electrode of the tenth transistor is electrically connected to the low voltage level end, and a second electrode of the tenth transistor is electrically connected to the first node.

7. The gate driving circuit of claim 6, further comprising:

a bootstrap capacitor;

wherein a first plate of the bootstrap capacitor is electrically connected to the first node and a second plate of the bootstrap capacitor is electrically connected to the first signal output end.

8. The gate driving circuit of claim 1, further comprising:

a reset circuit, comprising:

a reset signal end; and a reset transistor;

wherein a gate of the reset transistor is electrically connected to the reset signal end, a first electrode of the reset transistor is electrically connected to the first node, and a second electrode of the reset transistor is electrically connected to the low voltage level end.

9. The gate driving circuit of claim 1, wherein the third transistor is an amorphous silicon (a-Si) TFT or an Indium gallium zinc oxide (IGZO) TFT.

10. The gate driving circuit of claim 1, wherein the third transistor is an N-type transistor or a P-type transistor.

11. A display panel, comprising a gate driving circuit, the gate driving circuit comprising:

a pull-up control circuit, electrically connected to a first node, configured to pull up a voltage level of the first node in a display phase;

a signal transmission circuit, electrically connected to the first node and the pull-up control circuit, configured to pull up a voltage level of a first stage signal output end;

a pull up circuit, electrically connected to the first node and the pull-up control circuit, configured to pull up a voltage level of a first signal output end;

a pull down circuit, electrically connected to the first node, configured to pull down the voltage level of the first node in the display phase; and a pull-down maintaining circuit, electrically connected to the first node, configured to maintain a low voltage level of the first node, wherein the pull-down maintaining circuit comprises:

a low voltage level input end; and an inverter, comprising:

a high voltage level end;

a first low frequency clock signal end;

a second low frequency clock signal end;

a first transistor, wherein a gate of the first transistor is electrically connected to the first low frequency clock signal end, a first electrode of the first transistor is electrically connected to the high voltage level end;

a second transistor, wherein a gate of the second transistor is electrically connected to the second low frequency clock signal end, and a first electrode of the second transistor is electrically connected to the high voltage level end; and a third transistor, wherein a gate of the third transistor is electrically connected to the first node; a first electrode of the third transistor is electrically connected to a second electrode of the first transistor, a second electrode of the second transistor and a second signal output end; and a second electrode of the third transistor is electrically connected to the low voltage level input end.

12. The display panel of claim 11, wherein the pull-down maintaining circuit further comprises a fourth transistor, a fifth transistor, and the first node; a gate of the fourth transistor is electrically connected to the second signal output end, a first electrode of the fourth transistor is electrically connected to the first node, and a second electrode of the fourth transistor is electrically connected to the low voltage level input end; a gate of the fifth transistor is electrically connected to the second signal output end, a first electrode of the fifth transistor is electrically connected to the first signal output end, and a second electrode of the fifth transistor is electrically connected to the low voltage level input end.

13. The display panel of claim 12, wherein the pull-up control circuit comprises a sixth transistor, a first stage signal input end, and a first signal input end; a gate of the sixth transistor is electrically connected to the first stage signal input end, a first electrode of the sixth transistor is electrically connected to the first signal input end, and a second electrode of the sixth transistor is electrically connected to the first node.

14. The display panel of claim 13, wherein the signal transmission circuit comprises a seventh transistor and the first stage signal output end, a gate of the seventh transistor is electrically connected to the first node, a first electrode of the seventh transistor is electrically connected to a first clock signal input end, and a second electrode of the seventh transistor is electrically connected to the first stage signal output end.

15. The display panel of claim 14, wherein the pull up circuit comprises an eighth transistor, the first clock signal input end and the first signal output end; a gate of the eighth transistor is electrically connected to the first node, a first electrode of the eighth transistor is electrically connected to the first clock signal input end, and a second electrode of the eighth transistor is electrically connected to the first signal output end.

16. The display panel of claim 15, wherein the pull down circuit comprises a ninth transistor, a tenth transistor and a second signal input end, a gate of the ninth transistor is electrically connected to the second signal input end, a first electrode of the ninth transistor is electrically connected to the low voltage level end, and a second electrode of the ninth transistor is electrically connected to the first signal output end; a gate of the tenth transistor is electrically connected to the second signal input end, a first electrode of the tenth transistor is electrically connected to the low voltage level end, and a second electrode of the tenth transistor is electrically connected to the first node.

17. The display panel of claim 16, wherein the gate driving circuit further comprises:

a bootstrap capacitor;

wherein a first plate of the bootstrap capacitor is electrically connected to the first node and a second plate of the bootstrap capacitor is electrically connected to the first signal output end.

18. The display panel of claim 11, wherein the gate driving circuit further comprises:

a reset circuit, comprising:

a reset signal end; and a reset transistor;

wherein a gate of the reset transistor is electrically connected to the reset signal end, a first electrode of the reset transistor is electrically connected to the first node, and a second electrode of the reset transistor is electrically connected to the low voltage level end.

* * * * *